US005817226A

United States Patent [19]

Lenglet

[11] Patent Number: 5,817,226

[45] Date of Patent: Oct. 6, 1998

[54] PROCESS AND DEVICE FOR STEAM-CRACKING A LIGHT AND A HEAVY HYDROCARBON FEEDSTOCK

[75] Inventor: Eric Lenglet, La Celle St. Cloud, France

[73] Assignees: Linde Aktiengesellschaft, Wiesbaden, Germany; Procedes Petroliers Petrochimiques et SARL, Rueil-Malmaison, France

[21] Appl. No.: 615,319

[22] PCT Filed: Sep. 6, 1994

[86] PCT No.: PCT/EP94/02970

§ 371 Date: Jul. 10, 1996

§ 102(e) Date: Jul. 10, 1996

[87] PCT Pub. No.: WO95/07959

PCT Pub. Date: Mar. 23, 1995

[30] Foreign Application Priority Data

Sep. 17, 1993 [FR] France ..... 93 11119

[51] Int. Cl.[6] ..... C10G 9/36; F28D 21/00

[52] U.S. Cl. ..... 208/130; 208/132; 208/78; 208/80; 208/72; 208/75; 585/648; 585/652; 422/197; 422/204; 196/110; 196/116

[58] Field of Search ..... 208/130, 132, 208/78, 80, 72, 75; 585/648, 652; 422/197, 204; 196/110, 116

[56] References Cited

U.S. PATENT DOCUMENTS 3,579,601 5/1971 Kivlen ..... 208/72
4,268,375 5/1981 Johnson et al. ..... 208/72
4,492,624 1/1985 Johnson et al. ..... 208/78
4,552,644 11/1985 Johnson et al. ..... 208/78
4,615,795 10/1986 Woebcke et al. ..... 208/72
4,732,740 3/1988 Woebcke et al. ..... 422/193
4,906,442 3/1990 Johnson et al. ..... 422/188
5,190,634 3/1993 Fernandez-Baujin et al. ..... 208/132

*Primary Examiner*—Walter D. Griffin
*Attorney, Agent, or Firm*—Millen, White, Zelano, & Branigan, P.C.

[57] ABSTRACT

There is provided a process and a device with a convection zone (A) and a radiation zone (B) in a furnace (10), whereby the process includes: a first stage of precracking a feedstock of light hydrocarbons (1) and a second stage of final co-cracking of the mixture that is composed of this pre-cracked light feedstock (7) and a feedstock of heavy hydrocarbons (2). The process further includes: separate heating of the two feedstock streams (1 and 2) in the convection zone (A), in which the preheating temperature of each feedstock stream remains below the initial cracking temperature in each case; precracking (5) of the preheated light hydrocarbons; mixing of precracked light hydrocarbon stream (8) while a mixed stream (9) is formed; intense heating of mixed stream (9) to a temperature that is higher than the initial cracking temperature by virtue of the fact that the mixture is introduced into the radiation zone (B) of the furnace (10); and cooling (15) of cracked gases outside the furnace (10).

25 Claims, 4 Drawing Sheets

PROCESS AND DEVICE FOR STEAM-CRACKING A LIGHT AND A HEAVY HYDROCARBON FEEDSTOCK

BACKGROUND OF THE INVENTION

The invention relates to a process for steam cracking of hydrocarbons in a cracking furnace with a convection zone and a radiation zone, in which the process comprises a first stage of precracking a feedstock of light hydrocarbons and a second stage of final co-cracking of the mixture of this precracked feedstock of light hydrocarbons and a feedstock of heavy hydrocarbons. The invention further relates to a device for steam cracking of hydrocarbons; said device comprises a cracking furnace with a convection zone and a radiation zone, at least one preheating tube for a feedstock of light hydrocarbons in the convection zone for preheating this feedstock, whereby this tube is connected downstream to at least one cracking tube for the feedstock of light hydrocarbons to precrack them in the radiation zone, and at least one preheating tube for a feedstock of heavy hydrocarbons in the convection zone for preheating this feedstock.

The process of steam cracking is well known and represents one of the most important processes in petrochemistry.

In this case, a feedstock that consists of hydrocarbons and steam is evaporated and preheated in the convection zone of a steam cracking furnace. In the radiation zone of the furnace, an enormous increase in the temperature of this feedstock beyond the initial cracking temperature is carried out, and it results in cracking at a high temperature before the cracked gases are cooled and the cracking products are fractionated.

Within the scope of this invention, "feedstock" is defined as a mixture of hydrocarbons and steam. This applies to both light and heavy feedstocks. The mixture, either before this mixture is cracked or else even while it is being cracked, is referred to as feedstock. The hydrocarbon-containing fraction of the feedstock (the fraction without steam), i.e., the hydrocarbons consisting of the feedstock or the mixture of hydrocarbons and steam before the feedstock is cracked, is to be distinguished from the feedstock.

The preheating temperatures are normally in the range between 450° and 650° C., and the cracking temperatures (discharge temperature of the furnace) are usually in the range between 780° and 920° C.

The high values in the temperature intervals relate in general to the lightest feedstocks, and the low values relate to the relatively heavy feedstocks. For the feedstocks, the initiation of cracking in the convection zone is avoided if possible.

In connection with the invention, "initial cracking temperature" is defined as the temperature above which cracking of the hydrocarbons sets in or occurs to a significant extent and above which cracking always occurs more and more quickly. The initial cracking temperatures basically depend on the composition of the feedstock. The values of the initial cracking temperature are known to one skilled in the art.

In connection with the invention, the following different values apply, for example, to the indicated compositions of the feedstock:

| Composition of the hydrocarbon-containing fraction of the feedstock | Initial cracking temperature |
|---|---|
| $C_2$—$C_3$—$C_4$ | 720° C. |
| Naphtha | 710° C. |
| Kerosine, atmospheric gas oil | 690° C. |
| Vacuum gas oil | 680° C. |

These temperatures are conventional values. Since these temperatures generally do not represent any strict temperature values, temperatures that deviate by 10 to 20 K from the above-mentioned values could also be indicated. The above-indicated values correspond to very low cracking rates. In comparison with this, the temperatures normally are at least 100 K higher than the indicated temperature values at faster cracking rates. Such temperatures usually prevail at the outlet of the cracking furnace.

In a manner well known to one skilled in the art, an attempt is made to achieve a large rise in the temperature of the feedstock to the initial cracking temperature and beyond since this is advantageous for the yield. Quick cooling likewise enhances yield. The changes in temperature in the process basically correspond, in this case, to a "square" temperature profile.

In general, cracking hydrocarbon cuts that are too large and that contain very light and very heavy fractions is avoided since cracking of this type of mixture results either in inadequate cracking of the light fractions or in excessive cracking of the heavy fractions. Indeed, the light, heat-resistant fractions must be cracked at elevated temperature, i.e., with an elevated cracking intensity, in a specific furnace.

The cracking intensity is basically determined by the cracking conditions or specific parameters, such as the retention time of the feedstock in the cracking furnace, temperature, and dilution. At the same time, the cracking intensity reflects the importance of the retention time and the temperature. The cracking intensity can be measured based on various indices known to one skilled in the art (for example, based on the KSF index).

For the following designs, the index of cracking intensity can be defined as the conversion of a feedstock of standard pentane that is cracked under the same conditions, such as temperature, retention time, and dilution.

Except in the case where certain furnaces are not available (for example, a cracking furnace for decarbonized ethane), co-cracking of very different fractions with an identical cracking intensity that are contained in a mixture is generally avoided.

"Co-cracking" is defined as encompassing the execution of a process with combined cracking of light and heavy hydrocarbon feedstocks. In this case, the heavy hydrocarbon feedstock is generally contained in the main feedstock.

Numerous processes for co-cracking a light feedstock and a heavy feedstock with different cracking intensities for the light feedstock and the heavy feedstock are known. Apart from the fact that the effects of insufficient or excessive cracking are to be avoided, these processes are aimed at taking advantage of the energy that exists at high temperature, which is attributable to precracking of a light and consequently heat-resistant feedstock that is cracked at an elevated temperature for the cracking of the heavy feedstock, especially to bring, more or less on the spot, a preheated heavy feedstock to a point above its initial cracking point by mixing.

The second object of certain processes consists in using a precracked light feedstock as a diluent, which at least partially takes the place of the steam that is used for diluting the heavy feedstock.

It was already proposed that a small amount of a heavy feedstock (in general a gas oil) be injected into the cracked gases of naphtha. The amounts of the heavy feedstock that can be fed in are greatly reduced in this case (for example, 10% relative to naphtha), so that the mixture is at a cracking temperature of gas oil.

In general, a process referred to as "duo-cracking" has been proposed (see EP-B- 0 110 433), in which the heavy feedstock is precracked before it is mixed with the already cracked light feedstock. In this process, the percentage of the heavy feedstock may under certain circumstances be somewhat increased, and the goal of partially replacing the precracked light feedstock with steam can be achieved. The large temperature increase of the heavy feedstock is undesirable, however, since the latter is precracked at a very slight dilution (less than 0.2). Moreover, the additional conversion of the light feedstock in the course of the final common cracking is limited since the heavy feedstock is already precracked and the final common cracking can be carried out only at a reduced cracking intensity.

SUMMARY OF THE INVENTION

The object of the invention is to indicate a process and a device of the above-mentioned type, for which all the advantages of the above-described process can be maintained, but at the same time their disadvantages need not be tolerated. This means the invention should allow the following to be done as simultaneously as possible:

The use of an amount of a light feedstock that is smaller than the amount of the heavy feedstock, which has a positive effect during steam cracking, or renewed recracking of recycled light fractions ($C_2$ to $C_4$) in an amount that is smaller relative to the main feedstock (for example, naphtha), preference given to a large increase in the temperature of the heavy feedstock, the achievement of additional maximum conversion of the light feedstock during co-cracking, without problems of carbonization occurring.

The object of the invention is further to indicate a process and a device of the above-mentioned type in which the co-cracking can be implemented in pipe coils with a large and uniform throughput. In addition, the process and device are to be economical and allow very easy monitoring of the cracking parameters.

For the process according to the invention, this object is achieved by virtue of the fact that the process comprises the following steps:

a) Separate preheating of the two feedstock streams in the convection zone, in which case the preheating temperature of each feedstock stream remains below the initial cracking temperature in each case, b) precracking of the preheated light hydrocarbons, c) mixing of the precracked light hydrocarbon stream with the preheated and unprecracked heavy hydrocarbon stream while a mixed stream is formed, d) intense heating of the mixed stream to a temperature that is above the initial cracking temperature, by virtue of the fact that the mixture is introduced into the radiation zone of the furnace, e) implementation of a final co-cracking in the radiation zone of the furnace, and f) cooling, outside of the furnace, of the cracked gases that are produced during co-cracking.

The process according to the invention is advantageously designed so that process steps a) to c) comprise:

a) Separate preheating of the two feedstock streams in the convection zone to preheating temperatures greater than 300° C., b) precracking of preheated light hydrocarbons at a temperature in the range between 780° and 920° C., preferably between 800° and 900° C., and c) mixing of the precracked light hydrocarbon stream with the preheated and unprecracked heavy hydrocarbon stream while a mixed stream is formed, in which the amount and the temperature of each of the two streams are specified before mixing, in such a way that the temperature of the mixed stream is higher than 400° C. and lower than the initial cracking temperature.

The process according to the invention has a number of important advantages:

The first advantage consists of the fact that for a heavy feedstock, significant additional (maximum) cracking is achieved: Because the heavy feedstock is not precracked and mixing of the two feedstocks is done at a temperature that is below the initial cracking temperature, the cracking intensity that is achieved during the great temperature increase and the co-cracking of the mixture corresponds to the complete cracking intensity of the heavy feedstock.

Unlike the known processes, this complete cracking intensity allows additional maximum cracking of the light feedstock. This is of interest and of great advantage mainly with respect to the very heat-resistant light feedstocks, which cannot be cracked by more than approximately 60 to 65% or at least not by themselves without considerable carbonization problems, such as, for example, ethane.

The process allows additional conversion in the course of co-cracking, so that approximately 70 to 85% total conversion can be achieved.

In addition, the temperature that is necessary for mixing is relatively low, so that significantly larger amounts from the preheated (relatively cold) heavy feedstock than from the light feedstock can be used since their temperature at the end of precracking is very high indeed.

This is very well suited for the case where the light feedstock consists of downstream process stages, such as, for example, fractionation, recycled fractions of compounds with 2 to 5 carbon atoms (e.g., ethane, a $C_4$ and/or a $C_5$ cut). The light feedstock can also be obtained by cracking a main feedstock (heavy feedstock), such as, for example, naphtha. In this case,, the amount of recycled fractions hardly exceeds 15% of the amount of the heavy feedstock.

According to the invention, the amount of the hydrocarbon-containing light feedstock is less than 50%, preferably between 4% and 45%, and especially preferably between 5 and 35%, of the total amount of the two hydrocarbon-containing feedstocks.

The relatively great influence of the heavy feedstock thus allows considerable dilution of the light feedstock during co-cracking; this reduces the carbonization of the furnace due to the very intensive cracking of the light feedstock (carbonization is very great if, for example, ethane alone is cracked by more than 65% during conversion).

As far as the large increase in the temperature of the heavy feedstock (in a mixture) beyond the initial cracking temperatures is concerned, in contrast to the previously known process of co-cracking, this temperature increase is carried out by introducing the mixture into the radiation zone. This temperature increase is less than that caused by mixing, but it is always very rapid due to the low reactivity of the already precracked light feedstock. This low reactivity is achieved by the cooling of the precracked light feedstock during mixing. Cooling is done, in this case, by at least 60° C., preferably at least 80° C., and especially preferably at least 100° C. It makes possible a considerable reduction in the amount of cracked radicals. The cooled, precracked light feedstock thus actually behaves at least partially as a diluent.

The process allows the use of relatively small amounts of the light feedstock. Nevertheless the implementation of extensive additional cracking of this feedstock in which the carbonization problems that are connected with this intense cracking are avoided since the heavy feedstock is greatly diluted. This heavy feedstock is brought much more quickly to its cracking temperature, moreover, due to the presence of the light feedstock, which acts as diluent (effect of mutual dilution).

This production, according to the invention, of a relatively low-temperature mixture in which the precracked light feedstock is cooled is surprising and is unlike the processes known in the prior art. In these processes, the point is mainly rather to use an energy source of very high temperature (for example 850° C.), which consists of the precracked light feedstock. In these known processes, an attempt was accordingly made to use this heat vector at as high a heat level as possible, i.e., for the final cracking of the heavy feedstock ("duo-cracking process") or to ensure a large increase in the temperature of this heavy feedstock by mixing.

Surprisingly enough, it was noted in connection with the invention that unexpected advantages can be achieved by limiting the heat level of the energy vector used.

The principle of the process according to the invention is basically different from that of the known processes: instead of emphasizing the supplying of the light feedstock (supplying in two respects: energy vector and heavy feedstock as a diluent), thanks to the fact that the heavy feedstock functions as a diluent for this light feedstock an attempt is made in the process according to the invention to achieve extensive additional cracking of the light feedstock to limit its carbonization. As far as the energy level is concerned, the limitation of the heat level during use of the heat that is supplied via the precracked light feedstock produces no loss of energy.

In the embodiment of the process according to the invention, the mixed stream can be divided into a considerable number of individual streams after mixing, just before these individual streams are introduced into the radiation zone to bring the mixed stream abruptly to its initial cracking temperature. In particular, the mixed stream can advantageously be divided into the individual streams at a temperature that is below the initial cracking temperature of one of the two feedstock streams.

According to the invention, the mixed stream circulates at a temperature that is below the cracking temperatures of the two streams. After mixing, the mixed stream is divided into a considerable number of individual streams. Immediately after they are divided into individual streams, these individual streams are introduced into the radiation zone to bring the mixture abruptly to a temperature that is above the initial cracking temperatures of the two feedstocks. The individual streams then circulate in parallel at least in a first portion of the radiation zone.

According to the invention, one and the same mixing zone can be fed by a considerable number of cracking streams of the cracking zone or a considerable number of cracking processes can be carried out. According to the known processes, this happens separately or with at least partial merging of the streams in the end portion of the cracking coils according to the so-called "split coil" technique.

In this way, the number of mixing zones of a furnace and thus the number of pipe coils for precracking the light feedstock can be limited. A more reliable mode of operation and lower assembly costs are the result.

An important point should be emphasized here:

In the mixing zone, the mixture is divided or separated. The mixing zone often consists of distributor nozzles or venturi tubes. Owing to the selection of a low mixing temperature according to the invention, carbonization of the mixing zones can basically be prevented so that the feeding-in of the various streams is not also disrupted. Owing to the reduced temperature of the mixture, premature initiation of cracking in the separating zone, which would have an adverse effect on yield, can be prevented.

The ability, offered according to the invention, to fractionate the mixture without the problems of separation or carbonization and thus to use divided pipe coils ("split coils") for co-cracking allows the use of pipe coils with a highly uniform capacity, which reduces the costs for the furnace.

According to the invention, any light and heavy feedstocks can be used provided only that the average molecular weight of the hydrocarbon-containing fraction of the light feedstock is lower than that of the hydrocarbon-containing fraction of the heavy feedstock.

Highly suitable light feedstocks are those in which the hydrocarbon-containing fraction of these feedstocks consists for the most part of hydrocarbons with 2 to 5 carbon atoms, namely especially:

Ethane, preferably recycled ethane, the crude recycled $C_4$ cut or the $C_4$ cut after the extraction of butadiene or isobutene, recycled fractions that contain olefins with 5 carbon atoms and/or saturated fractions, for example, the recycled $C_4$ cut after hydrogenation.

These hydrocarbon-containing light feedstocks are typically in the range of the molecular weight that is preferred according to the invention for the light feedstock. Namely, according to the invention, the hydrocarbon-containing fraction in the feedstock of light hydrocarbons has an average molecular weight in the range between 25 and 60. This also corresponds to the average molecular weight of recycled unsaturated fractions.

The mixtures, which mainly consist of hydrocarbons of the group that comprises ethane and unsaturated recycled fractions (for example, the $C_4$ cut), are also especially suitable as hydrocarbon-containing fractions according to the invention in the feedstock of light hydrocarbons, in which ethane can improve the yield during cracking or cracking of the unsaturated fraction due to its function as a hydrogen dispenser, directly or via the intermediate stage of the molecular hydrogen that is produced during cracking. A hydrocarbon-containing fraction according to the invention is therefore preferred in the light hydrocarbon feedstock, which mainly consists of ethane, and preferably recycled ethane.

The hydrocarbon-containing fractions in the feedstock of heavy hydrocarbons preferably lie in the range of average molecular weight of between 70 and 500. These fractions mainly comprise naphtha, kerosine, and gas oil (atmospheric gas oil or vacuum gas oil).

The process according to the invention can also be carried out with ethane as a hydrocarbon-containing fraction of the light feedstock and with liquid gases (saturated or unsaturated $C_3$ and/or $C_4$ compounds) as a hydrocarbon-containing fraction of the heavy feedstock.

According to a special variant of the process according to the invention that is then especially advantageous, if the hydrocarbon-containing fraction of the light feedstock consists of ethane, the precracked light feedstock is subjected to a small amount of aging in a basically adiabatic zone in order to reduce its temperature by 10° to 50° C. before it is mixed with the preheated heavy feedstock.

According to another variant of the process according to the invention, the hydrocarbon-containing fraction of the heavy feedstock consists mainly of heavy fractions of the group of vacuum gas oils and distillates.

Preferably, especially in the case of a hydrocarbon-containing fraction of the heavy feedstock that is composed mainly of heavy fractions of the group of vacuum gas oils and distillates, the temperatures and amounts of the two feedstocks are set before mixing so that the preheated heavy feedstock is not completely evaporated and so that the complete evaporation of this feedstock is carried out by mixing with at least a portion of the precracked light feedstock.

Mixing can optionally also be carried out in several, especially two, stages: Mixing with a portion of the precracked light feedstock, so that the heavy feed stock completely evaporates, and then mixing with the remainder of the precracked light feedstock. Between the two mixing processes, the heavy feedstock that is completely evaporated by a portion of the precracked light feedstock can optionally be superheated by convection.

Optionally, the portion of the light feedstock that is used to completely evaporate the heavy feedstock can also be cooled slightly, for example, by mixing with a small amount of colder steam when excessively high temperatures in the mixing zone are to be avoided in the heavy feedstock. This is not absolutely necessary, however, and preferably the precracked light feedstock is not cooled (by a fluid fed in from outside). Where this is possible, complete evaporation of the heavy feedstock before reaching the mixing zone is also preferred.

The object at which the invention is aimed is achieved by a device of the above-mentioned type, which also comprises the following:

A mixing zone for the formation of a mixed stream with at least one inlet line for at least a portion of the precracked light hydrocarbon stream, which is connected to the upstream portion of the cracking tube for the feedstock of light hydrocarbons, and to at least one inlet line for the preheated and unprecracked heavy hydrocarbon stream, which is connected to the upstream portion of the preheating tube for a feedstock of heavy hydrocarbons, a separating zone for dividing the mixture into a considerable number of individual streams, a considerable number of circulation tubes arranged in parallel for the individual streams in the radiation zone to ensure a large temperature increase of the mixture, and at least one cracking tube for the mixture, which is connected upstream to at least one of the circulation tubes for the individual streams and downstream to devices for cooling the cracked gases.

With this device according to the invention, mixing can be carried out at a relatively low temperature that is sufficient to avoid premature cracking in the downstream separating zone or considerable carbonization of this zone.

According to the invention, another device is also proposed, and this device, in addition to the above-mentioned features, comprises the following:

A mixing zone located outside the furnace for the formation of a mixed stream with at least one inlet line for at least a portion of the precracked light hydrocarbon stream, which is connected to the upstream portion of the cracking tube for the feedstock of light hydrocarbons, and to at least one inlet line for the preheated and unprecracked heavy hydrocarbon stream, which is connected to the upstream portion of the preheating tube for a feedstock of heavy hydrocarbons, at least one transport tube for transporting the mixture from the outside of the furnace to the inside of the radiation zone, and this tube is connected upstream to the mixing zone and downstream to at least one circulation tube for mixing in the radiation zone, and devices for cooling the cracked gases that are produced during co-cracking.

In the case of this device, the mixing zone is arranged outside of the furnace, which considerably limits the carbonization of the furnace, and the mixture can pass unhindered at a relatively low temperature into the radiation zone, where the final co-cracking is carried out, without the danger of premature cracking or carbonization.

According to a characteristic embodiment of the invention, the mixing zone is also at the same time the zone in which the heavy feedstock finally evaporates. A very strong heat vector (the precracked light feedstock) is used to completely evaporate a very heavy feedstock, such as, for example, a vacuum gas oil or distillate, with a large safety margin.

Exploiting the advantages of the two above-described devices, in addition to the above-listed features, the device according to the invention can also comprise the following:

A mixing zone located outside the furnace for the formation of a mixed stream with at least one inlet line for at least a portion of the precracked light hydrocarbon stream, which is connected to the upstream portion of the cracking tube for the feedstock of light hydrocarbons, and to at least one inlet line for the preheated and unprecracked heavy hydrocarbon stream, which is connected to the upstream portion of the preheating tube for a feedstock of heavy hydrocarbons, a separating zone for dividing the mixture into a considerable number of individual streams, transport tubes for transporting individual streams from the outside of the furnace to the inside of the radiation zone, in which these tubes are connected upstream to the separating zone and downstream to circulation tubes for mixing in the radiation zone, a considerable number of circulation tubes arranged in parallel for the individual streams in the radiation zone to ensure a large increase in the temperature of the mixture, and at least one cracking tube for the mixture, which is connected upstream to at least one of the circulation tubes for the individual streams and downstream to devices for cooling the cracked gases that are produced during co-cracking.

In the embodiments of the devices according to the invention, two or more circulation tubes can be connected in the radiation zone of the furnace to at least one cracking tube.

Advantageously, the devices according to the invention can be designed by an adiabatic zone being provided outside the radiation zone between at least one cracking tube for the feedstock of light hydrocarbons for precracking of them and the inlet line for at least a portion of the precracked light hydrocarbon stream.

In further development of the devices, several cracking tubes can be connected to a device for cooling the cracked gases that are produced during co-cracking.

According to the invention, the preheating tube(s) for preheating the feedstock of light hydrocarbons in the convection zone inside the cracking furnace can be connected in the device to the cracking tube(s) for precracking the light hydrocarbons in the radiation zone.

The devices according to the invention are suitable especially for carrying out the process according to the invention.

BRIEF DESCRIPTION OF THE DRAWINGS

Below, the invention is explained in more detail based on several figures.

Here.

DETAILED DESCRIPTION OF THE DRAWINGS

Figure 1:
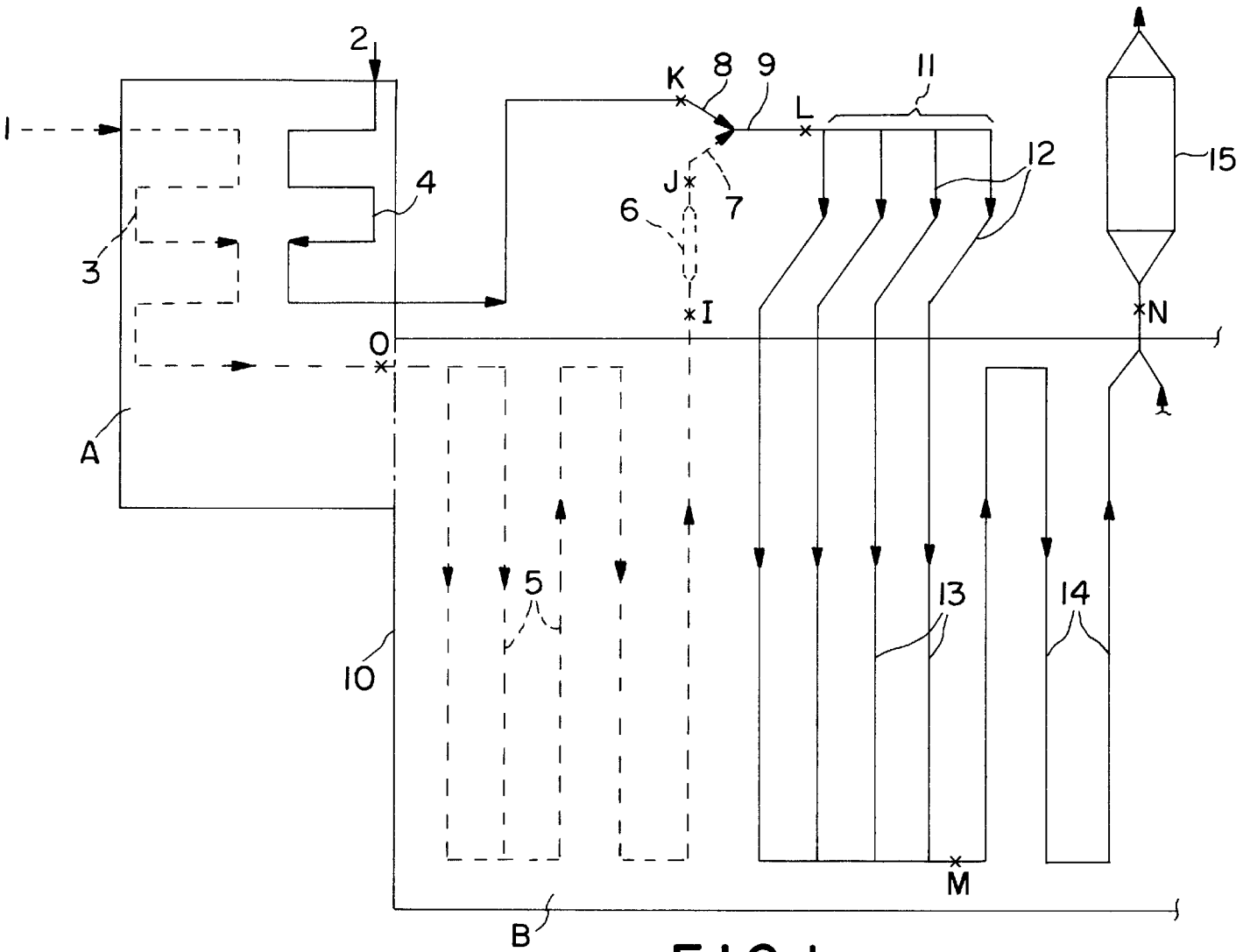
FIG. 1 shows a diagrammatic representation of a portion of a unit for steam cracking according to the invention.

In FIG. 1, a furnace 10 for steam cracking of hydrocarbons is very diagrammatically represented, which heats by means of convection and radiation and comprises preheating, circulation, and cracking tubes or bundles of preheating, circulation, and cracking tubes for hydrocarbons in order to preheat and to thermally crack the latter.

Furnace 10 that is shown in FIG. 1 comprises a first portion A, in which heating is done by means of convection and which is connected to a second portion B, in which heating is done by means of radiation. In portion B of the furnace, the very great rate of heat flow is generally supplied by burners (not shown), whose waste gases then circulate in first portion A of the furnace and ensure heating by means of convection. Furnace 10 that is shown in FIG. 1 can be supplemented by a second furnace half that is arranged in a mirror-symmetrical manner, not shown but indicated in FIG. 1.

First portion A of the furnace (convection zone) comprises one or more preheating tube(s) 4 for a hydrocarbon-containing heavy feedstock 2 and for steam, in which the hydrocarbons of this feedstock comprise mainly at least three carbon atoms (for example, a naphtha or a gas oil).

In addition, portion A of the furnace comprises one or more preheating tube(s) 3 for a light feedstock, which consists, for example, of ethane and steam, and these tube(s) 3 are indicated by broken lines in FIG. 1 to distinguish them from the tubes for the heavy feedstock, in which this heavy feedstock flows by itself or in a mixture.

Tubes 3 that are provided in first portion A of the furnace are connected to cracking tubes 5 in second portion B of the furnace (radiation zone).

The downstream end of tube 5 is connected to an aging zone 6, which consists of, for example, a tube with a length of between 1 and 10 m, whose diameter is larger than the diameter of the end section of tube 5.

At the outlet of aging zone 6, precracked light feedstock in inlet line 7 and preheated and unprecracked heavy feedstock in inlet line 8 are combined and mixed in a mixing zone while mixed stream 9 is formed. Downstream from the mixing zone, the mixture can be divided into a considerable number of individual streams 12 with the aid of a separating zone 11. These streams circulate in transport tubes 12 and are introduced into circulation tube 13 inside radiation zone B of furnace 10. The heat supply in radiation zone B to tube 13 produces the great increase in the temperature of the mixture beyond the original cracking temperatures of the two feedstocks. Tubes 13 are connected downstream to cracking tubes 14. In this case, circulation tubes 13 merge respectively into cracking tubes. Preferably, several circulation tubes 13 end in a cracking tube 14. Cracking tubes 14 and also 5 can be arranged in different ways (known in the art) in radiation zone B. In particular, several cracking tubes can be combined.

The cracked gases of the final co-cracking are then cooled in a quenching exchanger 15, preferably in a TLX heat exchanger (Transfer Line eXchanger).

This device for steam cracking operates in the following way:

Light feedstock 1, in which the hydrocarbon-containing portion preferably consists of ethane or of a mixture of recycling ethane and unsaturated recycling fractions, which consist of hydrocarbons with 3 to 6 carbon atoms—for example, a mixture of 30 to 70% ethane and in addition an unsaturated, recycled $C_4$ cut—is introduced at point 1. This feedstock is preheated by circulation in preheating tubes 3 (in one or more parallel passages) to a temperature in the range between 450° C. and 680° C., preferably of between 500° C. and 650° C., and specifically either to a temperature that is clearly below the original cracking temperature or, for example, to 720° C. if this feedstock contains mainly $C_3$ and $C_4$ hydrocarbons or portions of ethane and $C_3$ and $C_4$ compounds that are too similar. If two fractions are present in the same amounts, the original cracking temperature of the heavy feedstock is taken into consideration.

The light feedstock leaves convection zone A (after point 0) without noticeable incipient cracking. It is cracked in radiation zone B by circulation in tubes 5 at a starting temperature (at point 1) in the range between 780° and 920° C., and preferably between 800° and 900° C.

If the hydrocarbon-containing fraction in the light feedstock is ethane, conversion in the range between 40 and 65%, preferably between 50 and 65%, can be achieved during precracking, without excessively rapid carbonization of tubes 5 being produced. The conversion can also be considerably higher if the dilution of the light feedstock (portion of steam) is considerable. The dilution can vary between 0.2 and 1.2 (20 to 120% of the light feedstock).

If the light feedstock contains larger fractions of hydrocarbons with 4 or 5 carbon atoms, the ethane is converted during precracking preferably only in the range between 30 and 55% and especially preferably in the range between 35 and 50% so as not to crack too much the fractions that contain 4 or 5 carbon atoms during the last phase of the co-cracking.

The dilution (ratio of steam to hydrocarbon-containing fraction in the feedstock) of the light feedstock is generally between 0.2 and 1.2 and preferably between 0.25 and 1.

At the end of precracking, the light feedstock is directed through basically adiabatic aging zone 6, where a slight cooling occurs between points I and J, for example by 10° to 50° C. owing to the continuation of the crack reactions.

This aging zone 6 is especially important in the case where ethane is used since with it additional conversion can occur without the yield being significantly poorer and since the content of cracking radicals before the mixing zone can be reduced. The risk of premature cracking of the mixture is thus limited.

Aging zone 6, however, can also be omitted, especially in the case of light feedstocks other than ethane.

Precracked light feedstock 7 is now mixed with heavy feedstock 8 since the latter was preheated in tubes 4 of convection zone A.

The dilution of the heavy feedstock by steam can vary between 0.05 and 1, and preferably between 0.25 and 1.

At point K, shortly before the mixing zone, the preheating temperature of the heavy feedstock lies in the range between 300° and 650° C., and preferably between 450° and 650° C.

At point J, just ahead of the mixing zone, the temperature of the precracked light feedstock lies in the range between its original cracking temperature and 920° C., and preferably between 750° and 920° C.

After the two feedstocks are mixed in the mixing zone while mixed stream 9 is formed, the temperature of the mixture at point L is lower according to the invention than the original cracking temperatures of two feedstocks 1 and 2. This mixture is consequently less reactive. The mixture can therefore be divided with ease in separating zone 11 and be directed from the outside of furnace 10 into the interior of radiation zone B, without worrying about problems of premature cracking or carbonization of the lines. This advantage of the process is decisive since an optimum yield can thus be maintained and an unbalancing of the downstream co-cracking can be avoided. Such an unbalancing could be caused by carbonization of these lines since the latter frequently contain devices for regulating throughput such as nozzles or venturi tubes that are especially sensitive to carbonization.

In addition, the invention offers still further advantages:

1. Owing to its precracking and the significant cooling that occurs during mixing, the precracked and cooled light feedstock (cooled by more than 60° C., preferably by more than 80° C., and especially preferably by at least 100° C., relative to the temperature when leaving the precracking zone (point I) is left) is less reactive and thus behaves very much like a diluent. In this way, the heavy feedstock in tubes 13 can be heated considerably beyond its original cracking temperature, specifically owing to the effect of the increasing dilution, which benefits the heavy feedstock. Because of the cooling of the light feedstock, the amount of cracking radicals is considerably limited.
2. Since the precracked light feedstock is greatly diluted by the heavy, as yet uncracked feedstock, its tendency toward carbonization owing to a still uncracked and consequently less carbonizing feedstock is reduced. Thus, the tendency toward carbonization at point L is clearly less than at point I. As a result, additional conversion of the light feedstock during the final co-cracking is now possible, without the phenomena of carbonization being too pronounced. According to the process of the invention, values for the final conversion of ethane in the range between 70% and 85%, which cannot be achieved with the known processes, can be achieved with this additional conversion, without problems associated with carbonization occurring.

With the process according to the invention, unsaturated mixtures composed of ethane and $C_4$ hydrocarbons can also be cracked with an increased conversion (60 to 80% for the ethane) and positive effects relative to the yield from the cracking of the unsaturated fractions, which benefit from the higher ratio of H to C of ethane.

The typical temperatures at point L (mixing temperature) lie in the range between 400° and 710° C., and preferably in the range between 600° and 700° C. The very low values (400° to 500° C.) are used in the final evaporation of a heavy feedstock (vacuum gas oils and distillates).

Co-cracking is done after mixed stream 9 is heated beyond the original cracking temperature in circulation tubes 13 and especially in cracking tube 14. In the variant shown in FIG. 1, four parallel circulation tubes 13 are connected via center M to a cracking tube 14.

The control of process temperatures at point I or J (precracking), L (mixing), M and N (co-cracking) can be done by varying the heat of the burners and by varying the respective amount of the feedstock. A relatively cold fluid (such as, for example, water or less heated steam) can also be fed in at, for example, point O and/or at point I or J to control, for example, the temperature at point J.

Figure 2:
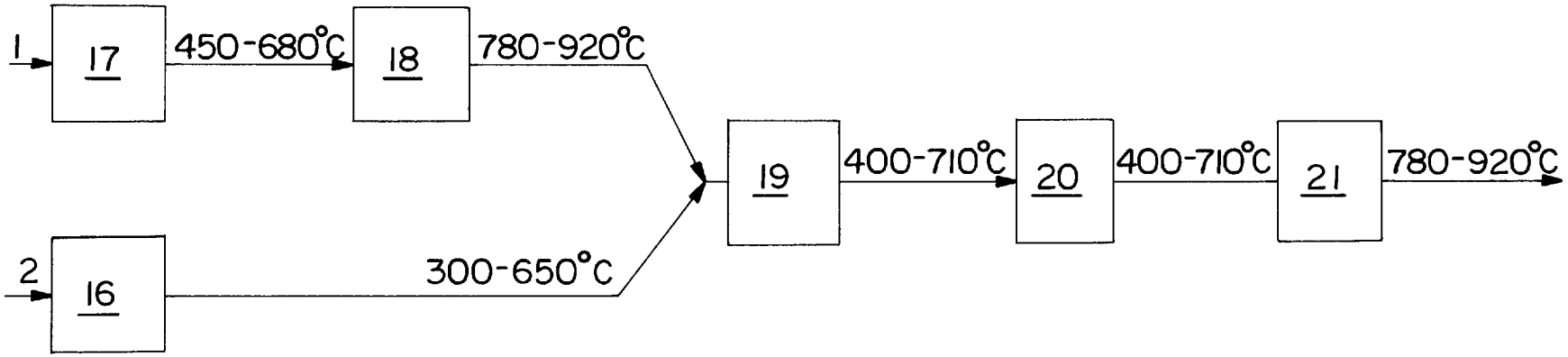
FIG. 2 shows a diagrammatic representation of the most important steps of the process according to the invention.

In FIG. 2, the most important, typical steps of the process as well as the corresponding temperatures are depicted in the case of a heavy feedstock of the naphtha or gas oil type.

The heavy feedstock is preheated (step 16). The light feedstock is preheated (step 17) and then precracked (step 18). The two feedstocks are then mixed (step 19). Finally, the mixture is divided and/or directed into the radiation zone (step 20), and then brought to a high temperature and cracked (section 21).

In FIGS. 3A–3F, various geometries for cracking pipe coils FIG. 3A to FIG. 3F are depicted, which can be used for precracking of the light feedstock and/or for greatly increasing the temperature of the mixture and the final co-cracking (tubes 5, 13 and 14).

Figure 3D:
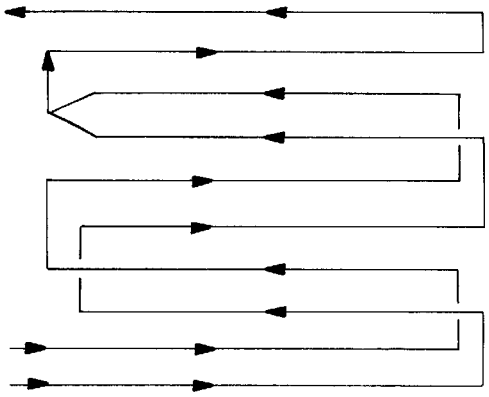
FIGS. 3A–3F show a diagrammatic representation of various embodiments of cracking pipe coils of a unit for steam cracking according to the invention.
Figure 3C:
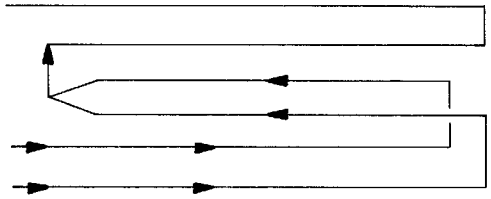
Figure 3B:
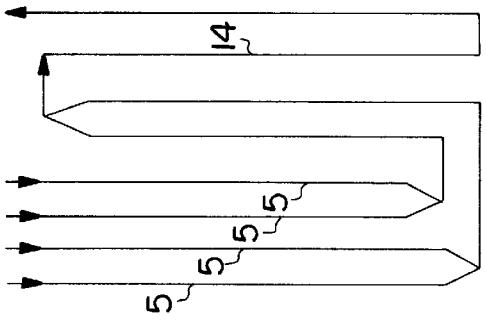
Figure 3F:
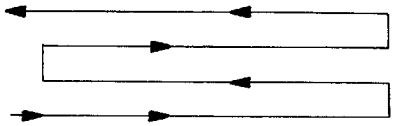
Figure 3A:
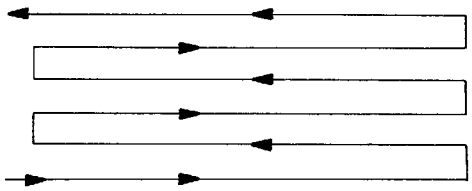
Figure 3E:
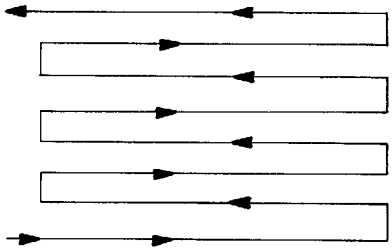

FIGS. 3A, 3E and 3F illustrate a cracking tube with 6, 8 and 4 passages, respectively, but with no combined tubes. FIG. 3B illustrates cracking tubes (5) end in two circulation tubes which feed into one cracking tube (14). FIGS. 3C and 3D illustrate two tubes end in one tube. The tubes FIGS. 3C and 3D can be interpreted as precracking tubes or as heating and co-cracking tubes.

In connection with this invention, the known, conventional pipe coils with 1, 2, 4, 6 or 8 passages (vertical lengths) or so-called split pipe coils can also be used.

Figure 4A:
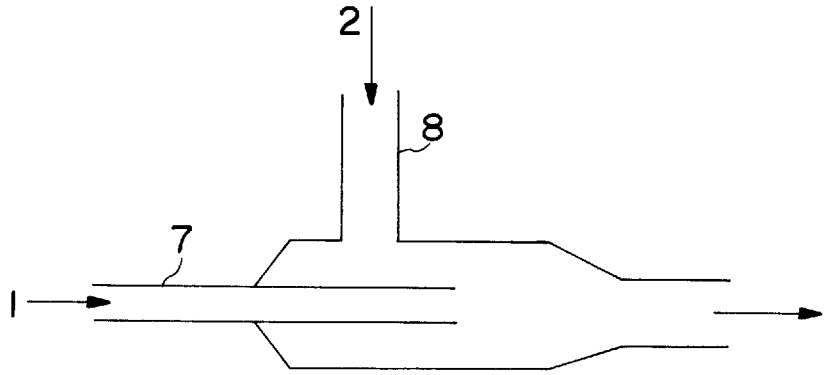
FIGS. 4A and 4B show diagrammatic views of two embodiments of the mixing zone of a unit for steam cracking according to the invention.
Figure 4B:
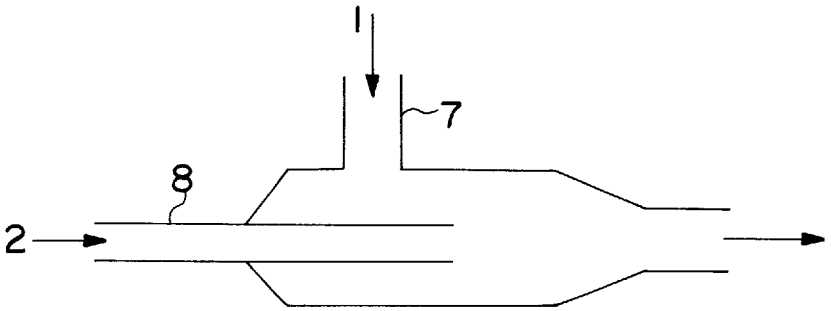

In FIGS. 4A and 4B, two embodiments FIG. 4A and FIG. 4B of the mixing zone are depicted, where the light feedstock and the heavy feedstock are fed to a mixing device with an annular space (either for the heavy, relatively cold feedstock or for the precracked light feedstock), and second case FIG. 4B is preferred if the heavy feedstock is not completely evaporated.

The invention is not limited to these mixing devices and types of pipe coils. In particular, all types of furnaces (with internal or external transition points, with mixing zones that are arranged inside or outside), pipe coils, mixers, processes for controlling the process temperature, etc. can be used without exceeding the scope of the invention.

I claim:

1. A process for steam cracking of hydrocarbons in a cracking furnace (10) with a convection zone (A) and a radiation zone (B), in which the process comprises a first stage of precracking of a feedstock of light hydrocarbons (1), and a second stage of final co-cracking of a mixture composed of resultant precracked feedstock of light hydrocarbons (7) and a feedstock of heavy hydrocarbons (2), wherein each feedstock has a initial cracking temperature, characterized in that the process comprises the following steps:

a) in the convection zone (A) separately preheating each the feedstock of light hydrocarbons and the feedstock of heavy hydrocarbons, in which the preheating temperature of each feedstock stream remains below the initial cracking temperature of each feedstock, b) precracking the preheated light hydrocarbons, c) mixing the precracked light hydrocarbon stream (7) with preheated and unprecracked heavy hydrocarbon stream (8) while a mixed stream (9) is formed, d) heating of the mixed stream (9) to a temperature higher than the initial cracking temperature thereof, by introducing the mixture into radiation zone (B) of said furnace (10), e) proceeding with a final co-cracking step in radiation zone (B) of said furnace (10), and f) cooling the resultant cracked gases produced during co-cracking, said cooling being conducted outside of said furnace (10).

2. A process according to claim 1, wherein steps a) to c) comprise:

a) separate preheating of two feedstock streams (1, 2) in said convection zone (A) to a preheating temperature above 300° C., b) precracking of the preheated light hydrocarbons at a temperature in the range between 780° and 920° C., and c) mixing of the precracked light hydrocarbon stream (7) with the preheated and unprecracked heavy hydrocarbon stream (8) while the mixed stream (9) is formed, and the amount and temperature of each of two streams (7, 8) being set before the mixing such that the temperature of the mixed stream (9) is above 400° C. and below the initial cracking temperature of the mixed stream.

3. A process according to claim 2 wherein said precracking of the preheated light hydrocarbons is conducted at temperature between 800° and 900° C.

4. A process according to claim 1, wherein after mixing, the mixed stream (9) is divided into a plurality of individual streams (12) immediately before these individual streams (12) are introduced into radiation zone (B) to bring the mixed stream (9) abruptly to its initial cracking temperature.

5. A process according to claim 4, wherein mixed stream (9) is divided into individual streams (12) at a temperature that is below the initial cracking temperature of one of two feedstock streams (7, 8).

6. A process according to claim 1, wherein the amount of hydrocarbons in the feedstock of light hydrocarbons (1) is less than 50 wt. % of the total amount of the hydrocarbons in the two feedstocks (1, 2).

7. A process according to claim 6, wherein the amount of the hydrocarbons in the feedstock of light hydrocarbons (1) is between 4 and 45 wt. %. of the total amount of the hydrocarbons in the feedstocks (1, 2).

8. A process according to claim 6, wherein the amount of the hydrocarbons in the feedstock of light hydrocarbons (1) is between 5 and 35 wt. %. of the total amount of the hydrocarbons in the feedstocks (1, 2).

9. A process according to claim 1, wherein the feedstock of light hydrocarbons (1) has a hydrocarbon content having an average molecular weight of between 25 and 60 and consists essentially of hydrocarbons with 2 to 5 carbon atoms.

10. A process according to claim 9, wherein the feedstock of light hydrocarbons (1) consists essentially of a mixture of ethane and recycled unsaturated hydrocarbon fractions.

11. A process according to claim 9, wherein the feedstock of light hydrocarbons (1) comprises a major amount of ethane.

12. A process according to claim 11, wherein the hydrocarbons in the feedstock of light hydrocarbon (1) comprise a major amount of recycled ethane.

13. Process according to claim 1, wherein the hydrocarbons in the feedstock of heavy hydrocarbons (2) have an average molecular weight of between 70 and 500.

14. Process according to claim 1, wherein the hydrocarbons in the feedstock of heavy hydrocarbons (2) comprises a major amount of at least one heavy fraction of vacuum gas oils or distillates.

15. Process according to claim 1, wherein precracked light hydrocarbon stream (7) in a substantially adiabatic zone (6) is subjected to aging, by the temperature of precracked light hydrocarbon stream (7) being lowered before precracked light hydrocarbon stream (7) is mixed with preheated heavy hydrocarbon stream (8).

16. Process according to claims 1, wherein the temperatures and amounts of two hydrocarbon streams (7, 8) before mixing are determined in such a way that preheated heavy hydrocarbon stream (8) is not completely evaporated before mixing, but rather that complete evaporation of this stream (8) is achieved by mixing it with at least one portion of precracked light hydrocarbon stream (7).

17. A process according to claim 1, wherein precracked light hydrocarbon stream (7) in a substantially adiabatic zone (6) is subjected to aging, by the temperature of precracked light hydrocarbon stream (7) being lowered by 10° to 50° C. before precracked light hydrocarbon stream (7) is mixed with preheated heavy hydrocarbon stream (8).

18. A device for steam cracking hydrocarbons, comprising:

a) a cracking furnace (10) with a convection zone (A) and a radiation zone (B), b) at least one preheating tube (3) for a feedstock of light hydrocarbons (1) in convection zone (A) for preheating feedstock, said preheating tube being connected downstream to at least one cracking tube (5) for the feedstock of light hydrocarbons (1) in order to precrack them in radiation zone (B), and c) at least one preheating tube (4) for a feedstock of heavy hydrocarbons (2) in convection zone (A) for preheating this feedstock, d) a mixing zone for forming a mixed stream (9) with at least one inlet line (7) for at least a portion of the precracked light hydrocarbon stream, which is connected to the upstream portion of cracking tube (5) for the feedstock of light hydrocarbons (1), and to at least one inlet line (8) for the preheated and unprecracked heavy hydrocarbon stream, which is connected to the upstream part of preheating tube (4) for a feedstock of heavy hydrocarbons (2), e) a separating zone (11) for dividing the mixed stream into a plurality of individual streams, f) a plurality of circulation tubes (13) that are arranged in parallel for the individual streams in radiation zone (B) in order to ensure a large increase in the temperature of the mixed stream, and g) at least one cracking tube (14) for the mixed stream, which is connected upstream to at least one of circulation tubes (13) for the individual streams and downstream to devices (15) for cooling cracked gases.

19. Device according to claims 18, wherein two or more circulation tubes (13) are connected to at least one cracking tube (14) in radiation zone (B) of furnace (10).

20. Device according to claims 18, wherein an adiabatic zone (6) is provided outside radiation zone (B) between at least one cracking tube (5) for the feedstock of light hydrocarbons (1) to precrack them and inlet line (7) for at least a portion of the precracked light hydrocarbon stream.

21. Device according to claims 18, wherein a plurality of cracking tubes (14) are connected to a device (15) for cooling the cracked gases that are produced during co-cracking.

22. Device according to claims 18, wherein preheating tube(s) (3) for preheating the feedstock of light hydrocarbons (1) in convection zone (A) inside cracking furnace (10) is/are connected to cracking tube(s) (5) for precracking light hydrocarbons (1) in radiation zone (B).

23. Device for steam cracking hydrocarbons, comprising:

a) a cracking furnace (10) with a convection zone (A) and a radiation zone (B), b) at least one preheating tube (3) for a feedstock of light hydrocarbons (1) in convection zone (A) for preheating this feedstock, and this tube is connected downstream to at least one cracking tube (5) for the feedstock of light hydrocarbons (1) to precrack them in radiation zone (B) and c) at least one preheating tube (4) for a feedstock of heavy hydrocarbons (2) in convection zone (A) for preheating this feedstock, wherein it also comprises the following:

d) a mixing zone located outside furnace (10) for forming a mixed stream (9) with at least one inlet line (7) for at least a portion of the precracked light hydrocarbon stream, which is connected to the upstream portion of cracking tube (5) for the feedstock of light hydrocarbons (1), and to at least one inlet line (8) for the preheated and unprecracked heavy hydrocarbon stream, which is connected to the upstream portion of preheating tube (4) for a feedstock of heavy hydrocarbons (2), e) at least one transport tube (12) for transporting the mixed stream from the outside of furnace (10) to the inside of radiation zone (B), in which this tube (12) is connected upstream to the mixing zone and downstream to at least one circulation tube (13) for mixing in radiation zone (B) and f) devices (15) for cooling the cracked gases that are produced during co-cracking.

24. Device for steam-cracking of hydrocarbons, comprising:

a) a cracking furnace (10) with a convection zone (A) and a radiation zone (B), b) at least one preheating tube (3) for a feedstock of light hydrocarbons (1) in convection zone (A) for preheating this feedstock, and this tube is connected downstream to at least one cracking tube (5) for the feedstock of light hydrocarbons (1) to precrack them in radiation zone (B) and c) at least one preheating tube (4) for a feedstock of heavy hydrocarbons (2) in convection zone (A) for preheating this feedstock, wherein it also comprises the following:

d) a mixing zone located outside furnace (10) for forming a mixed stream (9) with at least one inlet line (7) for at least a portion of the precracked light hydrocarbon stream, which is connected to the upstream portion of cracking tube (5) for the feedstock of light hydrocarbons (1), and to at least one inlet line (8) for the preheated and unprecracked heavy hydrocarbon stream, which is connected to the upstream portion of preheating tube (4) for a feedstock of heavy hydrocarbons (2), e) a separating zone (11) for dividing the mixed stream into a plurality of individual streams, f) transport tubes (12) for transporting individual streams from the outside of furnace (10) to the inside of radiation zone (B), in which case these tubes (12) are connected upstream to separating zone (11) and downstream to circulation tubes (13) for mixing in radiation zone (B), g) a plurality of circulation tubes (13) that are arranged in parallel for the individual streams in radiation zone (B) to ensure a large increase in the temperature of the mixture, and h) at least one cracking tube (14) for the mixture, which is connected upstream to at least one of circulation tubes (13) for the individual streams and downstream to devices (15) for cooling the cracked gases that are produced during co-cracking.

25. Device for stream cracking hydrocarbon, comprising:

a) a cracking furance (10) with a convention zone (A) and a radiation zone (B), b) at least one preheating tube (3) for a feedstock of light hydrocarbons (1) in convection zone (A) for preheating this feedstock, and this tube is connected downstream to at least one cracking tube (5) for the feedstock of light hydrocarbons (1) to precrack them in radiation zone (B) and c) at least one preheating tube (4) for a feedstock of heavy hydrocarbons (2) in convection zone (A) for preheating this feedstock, wherein it also comprises the following:

d) a mixing zone located outside furnace (10) for forming a mixed stream (9) with at least one inlet line (7) for at least a portion of the precracked light hydrocarbon stream, which is connected to the upstream portion of cracking tube (5) for the feedstock of light hydrocarbons (1), and to at least one inlet line (8) for the preheated and unprecracked heavy hydrocarbon stream, which is connected to the upstream portion of preheating tube (4) for a feedstock to heavy hydrocarbons (2), e) at least one transport tube (12) for transporting the mixed stream from the outside of furnace (10) to the inside of radiation zone (3), in which this tube (12) is connected upstream to the mixing zone and downstream to at least one circulation tube (13) for mixing in radiation zone (B) and f) at least one cracking tube (14) for the mixed stream, which is connected upstream to at least one of circulation tubes (13) for the mixed stream and downstream to devices (15) for cooling the cracked gases that are produced during co-cracking.

* * * * *